US006042850A

United States Patent [19]

Ida et al.

[11] Patent Number: 6,042,850

[45] **Date of Patent: *Mar. 28, 2000**

[54] NURSING BOTTLE UTILIZING AIR PRESSURE TO EXPEL AIR FROM DISPOSABLE LINERS AND METHODS USING SAME FOR FEEDING AN INFANT

[76] Inventors: Frank Ida, 1 Jillet Dr., Smithtown, N.Y. 11787; Luciano Di Scala, 111 Arpage Dr., Shirley, N.Y. 11967

[ * ] Notice: This patent is subject to a terminal disclaimer.

[21] Appl. No.: 08/991,368

[22] Filed: Dec. 16, 1997

Related U.S. Application Data

[63] Continuation-in-part of application No. 08/517,709, Aug. 21, 1995, Pat. No. 5,699,920.

[51] Int. Cl.[7] ..... A51J 9/00

[52] U.S. Cl. ..... 426/2; 426/115; 426/117; 215/11.1; 215/11.3; 215/11.4; 215/11.5; 215/11.6

[58] Field of Search ..... 215/11.1, 11.3, 215/11.4, 11.6, 11.5; 426/117, 115; 420/2

[56] References Cited

U.S. PATENT DOCUMENTS

| | | |
|---|---|---|
| 362,554 | 5/1887 | Suydam . |
| 985,328 | 2/1911 | Decker . |
| 1,037,309 | 9/1912 | Poore . |
| 1,998,646 | 4/1935 | Yager . |
| 2,110,928 | 3/1938 | De Buys . |
| 2,394,722 | 2/1946 | Sloane . |
| 2,469,489 | 5/1949 | Allen et al. . |
| 2,550,210 | 4/1951 | Vance, Jr. . |
| 2,624,485 | 1/1953 | Boston . |
| 2,793,778 | 5/1957 | Maxwell . |
| 2,804,995 | 9/1957 | Fee . |
| 2,846,103 | 8/1958 | Maxwell . |
| 3,162,318 | 12/1964 | Woodberry, Jr. . |
| 3,232,467 | 2/1966 | Barton . |
| 3,292,808 | 12/1966 | Green . |
| 3,511,407 | 5/1970 | Palma . |
| 3,648,873 | 3/1972 | Grobbel . |
| 3,718,140 | 2/1973 | Yamauchi . |
| 3,768,682 | 10/1973 | Meyers et al. . |
| 3,768,683 | 10/1973 | Van Den Bosch . |
| 3,955,698 | 5/1976 | Hammer . |
| 3,998,348 | 12/1976 | Sammaritano . |
| 4,010,861 | 3/1977 | Welten . |
| 4,020,978 | 5/1977 | Szczepanski . |
| 4,176,745 | 12/1979 | Miller . |
| 4,241,768 | 12/1980 | Keller et al. . |
| 4,295,582 | 10/1981 | Acres . |
| 4,339,046 | 7/1982 | Coen . |
| 4,401,224 | 8/1983 | Alonso . |
| 4,466,547 | 8/1984 | Klittich . |
| 4,469,250 | 9/1984 | Evezich . |
| 4,545,491 | 10/1985 | Bisgaard et al. . |
| 4,613,050 | 9/1986 | Atkin et al. . |
| 4,657,151 | 4/1987 | Cabernoch . |
| 4,676,387 | 6/1987 | Stephenson et al. . |

(List continued on next page.)

FOREIGN PATENT DOCUMENTS

| | | |
|---|---|---|
| 0009460 | 2/1980 | European Pat. Off. . |

*Primary Examiner*—David Lacey
*Assistant Examiner*—Han Mai

[57] ABSTRACT

A nursing bottle having a body, a flexible liner, and a feeding nipple. In one embodiment, the body includes a check valve to allow air into a chamber formed between the body and the flexible liner to equalize the pressure in the chamber and prevent air from leaving the chamber. This prevents the liner from expanding and air from reentering the liner. Other embodiments of the nursing bottle include a pump for introducing pressurized air into the chamber and thereby expelling air from the liner. In still other embodiments, the bottle comprises a two-part body in which the parts of the body are slidably and sealably engageable with each other wherein movement of the parts relative to each other pressurizes the air in the chamber and expels air from the liner. Disclosed are also methods of feeding an infant or animal utilizing such nursing bottles.

6 Claims, 8 Drawing Sheets

U.S. PATENT DOCUMENTS

| | | | |
|---|---|---|---|
| 4,730,744 | 3/1988 | Vinciguerra . | |
| 4,821,896 | 4/1989 | Cheng . | |
| 4,828,126 | 5/1989 | Vincinguerra . | |
| 4,842,165 | 6/1989 | Van Coney . | |
| 4,880,125 | 11/1989 | Le Beau . | |
| 4,928,836 | 5/1990 | Wu et al. . | |
| 4,944,418 | 7/1990 | Wallace . | |
| 4,979,629 | 12/1990 | Askerneese . | |
| 5,033,631 | 7/1991 | Nightingale . | |
| 5,069,351 | 12/1991 | Gunderson . | |
| 5,109,996 | 5/1992 | Sullivian . | |
| 5,211,299 | 5/1993 | Manfredonia | 215/11.1 |
| 5,284,261 | 2/1994 | Zambuto . | |
| 5,301,825 | 4/1994 | Di Scala et al. . | |
| 5,318,204 | 6/1994 | Davis et al. . | |
| 5,332,121 | 7/1994 | Schmidt et al. | 222/95 |
| 5,356,016 | 10/1994 | Wiedemann . | |
| 5,431,290 | 7/1995 | Vinciguerra . | |
| 5,499,729 | 3/1996 | Greenwood et al. . | |
| 5,524,783 | 6/1996 | Popoff . | |
| 5,687,861 | 11/1997 | Wiedeman | 215/11.3 |
| 5,921,426 | 7/1999 | Randolph | 220/495.06 |

NURSING BOTTLE UTILIZING AIR PRESSURE TO EXPEL AIR FROM DISPOSABLE LINERS AND METHODS USING SAME FOR FEEDING AN INFANT

CROSS REFERENCE TO RELATED APPLICATION

This is a continuation-in-part of application Ser. No. 08/517,709 filed on Aug. 21, 1995 and which issued as U.S. Pat. No. 5,699,920 on Dec. 23, 1997.

The present invention relates to nursing bottles utilizing air pressure to expel air from disposable liners and preventing air from reentering the nursing bottles liner, and a method using such bottles for feeding an infant or an animal. Air which is trapped in a liner of a nursing bottle is often ingested by the baby feeding from the nursing bottle. This air ends up in the baby's stomach and can cause pain and regurgitation. The elimination of the air from the liner prevents the baby from ingesting the air and so reduces the possibility of the negative side effects associated with air in the baby's stomach.

BACKGROUND OF THE INVENTION

The problem of air in a disposable liner of nursing bottles has been recognized for some time. The prior art disclose devices which are used to eliminate air from the liner. For example, the prior art disclose the use of plungers, such as those disclosed in U.S. Pat. No. 5,524,783 to Popoff, U.S. Pat. No. 4,880,125 to LeBleau, and U.S. Pat. No. 3,648,873 to Grobbel. The end of the plunger is used to mechanically collapse the liner toward a nipple on the nursing bottles which causes a decrease in volume of the liner. As the liquid in the liner moves upward in response to the mechanical pressure from the plunger, the air in the liner is expelled through the nipple. A similar device is disclosed in U.S. Pat. No. 4,176,745 to Miller that has a pneumatic member (12) that applies a force to a liner to expel air in the liner.

A problem with these devices is that, if the plunger or pneumatic member is removed, there is nothing to prevent the liner from re-expanding and air being reintroduced into the liner. This necessitates that the liner again be collapsed to expel the air before the nursing bottle is used to feed an infant.

Many nursing bottles use disposable liners. These liners provide for easy cleaning as they are simply thrown away after use and replaced. Many of these nursing bottles have apertures in the bottoms to allow air into the bottle as the baby takes liquid from the nursing bottle. This allows the pressure around the liner to be equal to the pressure outside of the nursing bottle. Examples of these types of nursing bottles are U.S. Pat. No. 2,987,209 to Leonard and U.S. Pat. No. 2,846,103 to Maxwell.

Still other nursing bottles do not use liners, but employ a valve on the bottom of the bottle. Examples include U.S. Pat. No. 3,768,682 to Myers et al., U.S. Pat. No. 3,292,808 to Greene, and U.S. Pat. No. 3,511,407 to Palma. The valve allows air to enter the nursing bottle to replace the volume of liquid that is consumed by the infant during feeding. The valve opens when the pressure in the bottle is less than the pressure outside of the nursing bottle. The valve prevents the liquid in the nursing bottle from leaking when the nursing bottle is in the upright position.

SUMMARY OF THE INVENTION

Accordingly, it is an object of the present invention to provide nursing bottles, especially intended for human infants or animals, which utilize air pressure to collapse a liner and expel air from the liner, e.g., expel air out of the liner via the nipple.

It is another object of the present invention to provide nursing bottles which utilize air pressure to prevent air from being drawn back into the liner while feeding of an infant.

It is another object of the present invention to provide nursing bottles which promotes upright feeding by keeping the nipple full of liquid during feeding.

It is another object of the present invention to provide nursing bottles which are easy to use and operate.

It is a further object of the present invention to provide nursing bottles which are economically and easily manufactured for widespread sale and use.

Certain of the foregoing and related objects are readily obtained in a nursing bottle comprising a body having an open end and an aperture, a flexible liner suspendable from the open end of the body so as to create a chamber between the liner and the body, a feeding nipple attachable to the open end of the body, and a check valve for regulating a flow of air through the aperture and into the chamber. When fluid contained within the liner is removed during feeding, a vacuum is created in the chamber to readily draw air into the chamber through the valve so as to compensate for the volume of liquid removed from the liner, and when feeding stops the valve prevents air from exiting the chamber and air from being drawn through the nipple and into the liner.

Certain of the foregoing and related objects are also readily obtained in a nursing bottle for feeding an infant or an animal in which the bottle comprises a rigid body having an open end and an aperture, a flexible liner suspendable from the open end of the body so as to create a chamber between the liner and the body, a feeding nipple attachable to the open end of the body, and means for pumping air into the chamber, wherein the pump means is operable to pressurize the chamber and to expel air from the liner.

Certain of the foregoing and related objects are also readily obtained in a nursing bottle comprising a multi-part body comprising a hollow cylindrical upper portion having an upper open end, and a lower portion, the upper portion and the lower portion being slidably and sealably engageable with each other, a flexible liner suspendable from the open upper end of the upper portion of the body so as to create a chamber between the liner and the upper portion and the lower portion of the body, and a feeding nipple attachable to the open upper end of the upper portion of the body. Slidably engaging the upper and lower portions of the body pressurizes air in the chamber to expel air from the liner and prevent air from being drawn through the nipple and into the liner. Advantageously, at least one of the upper and lower portions of the body comprises a check valve.

Preferably, the embodiments of the above-noted nursing bottles further comprise a rigid body and a retaining ring for attaching the nipple to the body. Desirably, the check valve comprises silicone rubber and the nipple is self-sealing.

Certain of the foregoing and related objects are further readily obtained in methods of feeding an infant or animal in which the method comprising the steps of providing a nursing bottle according the various embodiment described above, filling the liner with a liquid, and feeding the liquid through the nipple to the infant or animal. When fluid contained within the liner is removed during feeding, a vacuum is created in the chamber to readily draw air into the chamber through a valve so as to compensate for the volume of liquid removed from the liner, and when feeding stops the valve prevents air from being drawn through the nipple and into the liner. In the embodiments comprising a pump, operating the pump introduces air or pressurizes air in the chamber to expel air from the liner prior to feeding and/or periodically during feeding.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
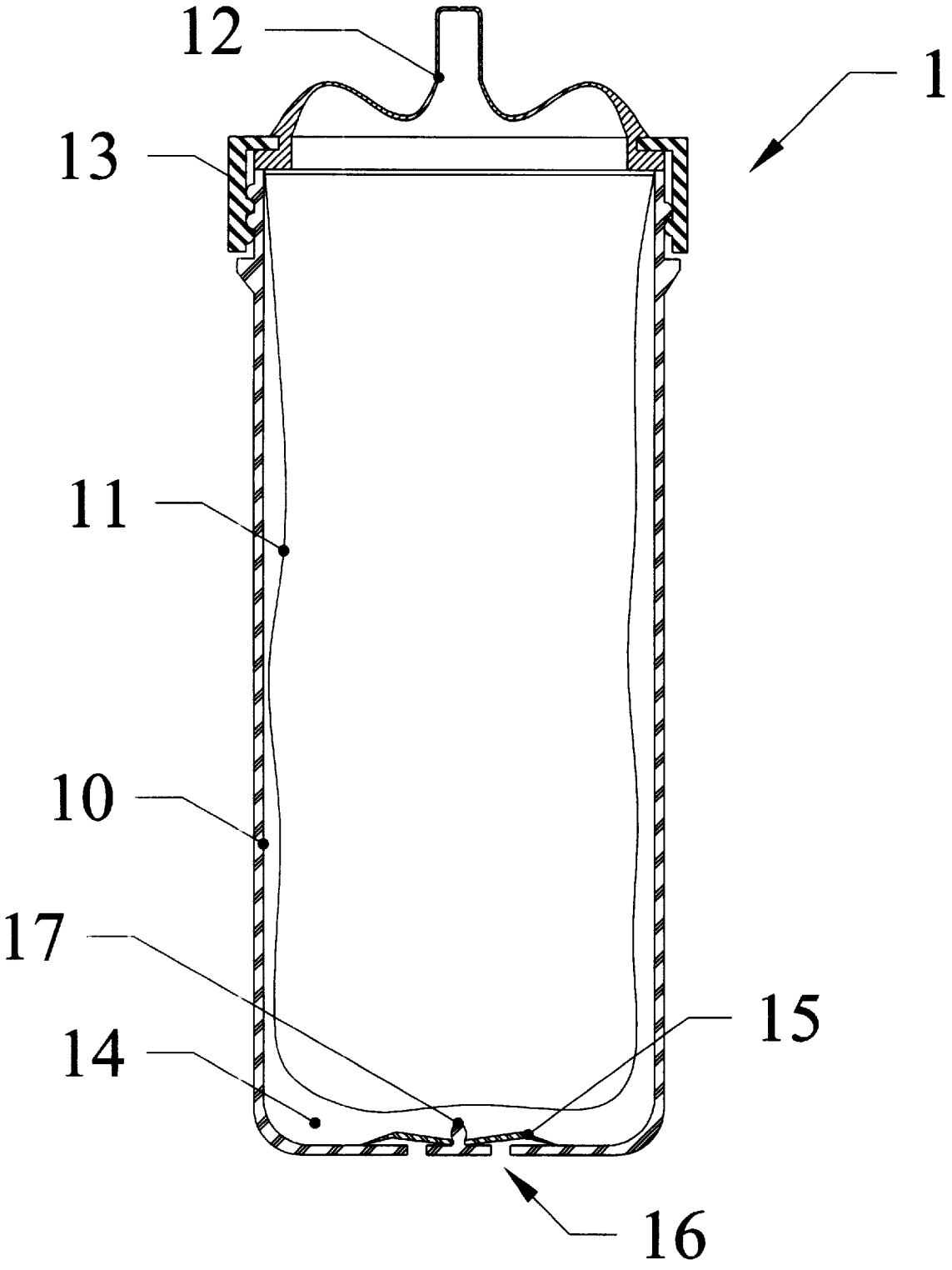
FIG. 1 is a cross-sectional view of one embodiment of a nursing bottle according to the parent application.

Referring to FIG. 1, the structure of a nursing bottle 1 for feeding infants or animals according to one embodiment of the parent application can be seen. Nursing bottle 1 is preferably made of plastic (e.g., a random co-polymer of the polypropylene family) and has a resilient body 10 that has an open upper end and a bottom end having an aperture 16. Aperture 16 is sealed with a check valve 15, e.g., a valve permitting the flow of air in one direction only. Preferably, check valve 16 is made from silicone rubber. A projection 17 of body 10 connects check valve 15 to body 10. The open upper end of body 10 is connected to a nipple 12 having an orifice 18, preferably made of latex or silicone rubber. Preferably, orifice 18 of nipple 12 is self-sealing. Desirably, nipple 12 is connectable to body 10 by a screw-on retaining ring 13. Retaining ring 13 includes internal threads that mate with external threads on body 10. Secured between the mating threads is a pouch or bag-like liner 11 that holds liquid (not shown in FIG. 1) that is fed to an infant. The space between liner 11 and body 10 defines a chamber 14.

Figure 2:
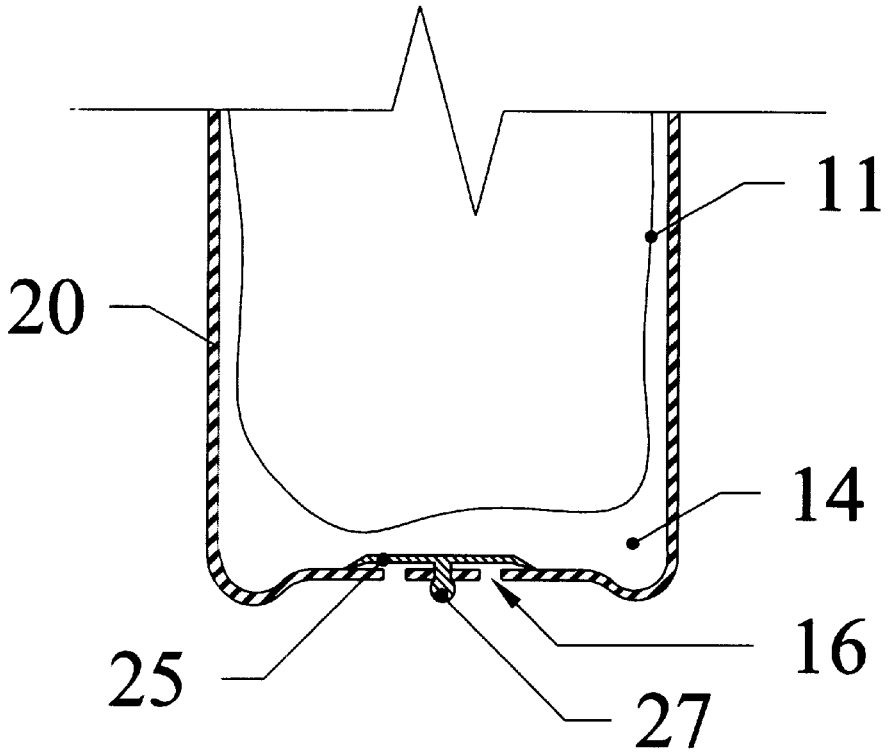
FIG. 2 is a detail of the lower half of the nursing bottle shown in FIG. 1.
Figure 3:
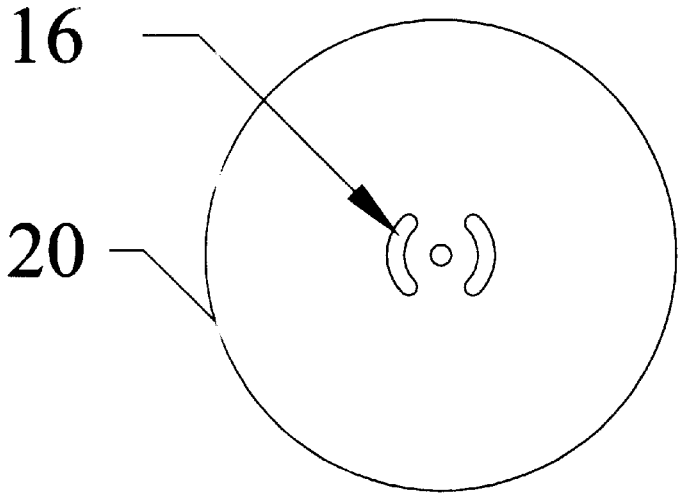
FIG. 3 is a bottom view of the nursing bottle shown in FIG. 1.

FIGS. 2 and 3 illustrate an alternative embodiment for attachment of a check valve 25 to a body 20. In this embodiment a projection 27 of check valve 25 connects to body 20.

Figure 4:
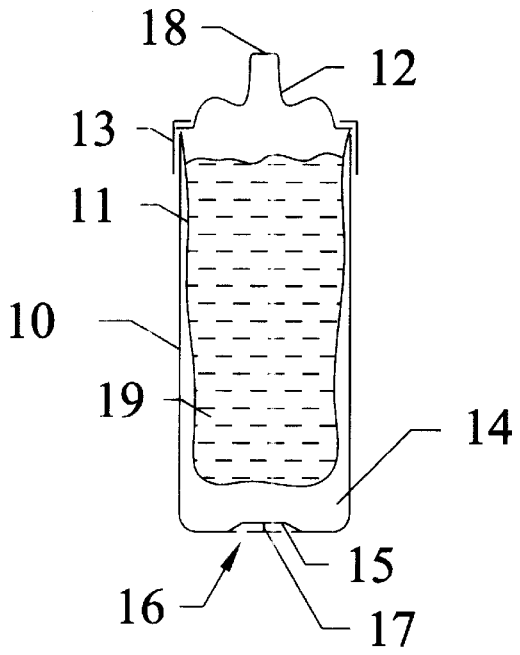
FIG. 4 is a cross-sectional view of the nursing bottle shown in FIG. 1 in an initial state with liquid and air in the liner, e.g., prior to feeding.
Figure 5:
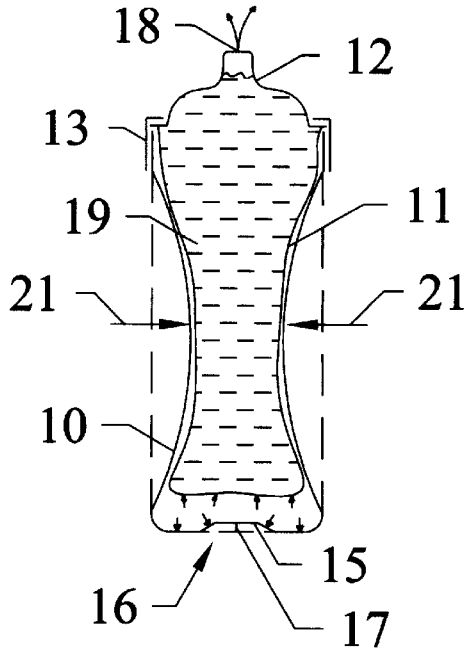
FIG. 5 is a cross-sectional view of the nursing bottle shown in FIG. 4 in which the nursing bottle is squeezed so that the liquid in the liner rises and the air is expelled from the liner.

The operation of nursing bottle 1 is best shown with reference to FIGS. 4–7. FIG. 4 shows nursing bottle 1 with liner 11 initially filled with liquid 19 and air. FIG. 5 illustrates nursing bottle 1 as forces 21 apply pressure to body 10, e.g., manually squeezing body 10 with one's hand. As shown in FIG. 5, body 10 is in a collapsed state. As body 10 is collapsed, the size of chamber 14 decreases. Air cannot escape chamber 14 through check valve 15 because the pressure prevents valve 15 from opening. The pressure in chamber 14 acts on liner 11 causing liquid 19 in the liner to rise. This causes the air in the liner to be expelled through orifice 18 in nipple 12.

Figure 6:
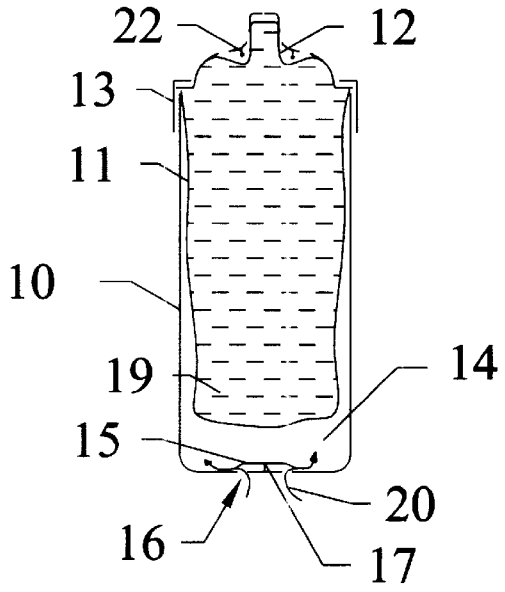
FIG. 6 is a cross-sectional view of the nursing bottle shown in FIG. 5 in which the body of the nursing bottle expands as air enters through the aperture in the body.

Turning now to FIG. 6, the operation of nursing bottle 1 when the pressure is released can be seen. With liner 11 collapsed and the air in liner 11 expelled, liner 11 occupies a smaller volume than it previously did before application of forces 21. The result is that chamber 14 will be greater than it was previously (FIG. 4). As body 10 expands, the air pressure in the chamber 14 decreases as its volume increases. Specifically, when the volume of chamber 14 becomes greater than it was in its original state (FIG. 4), the pressure falls below the pressure outside body 10, e.g., a vacuum is created in chamber 14. This pressure differential causes check valve 15 to open and air 20 to enter chamber.

Figure 7:
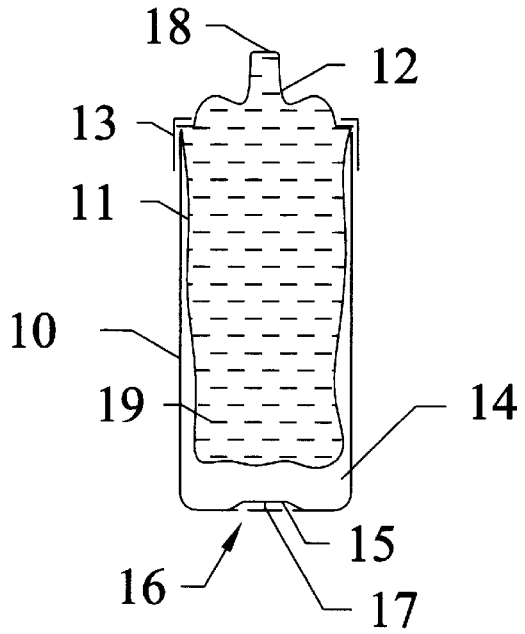
FIG. 7 is a cross-sectional view of the nursing bottle shown in FIG. 6 with the returned to its initial state with the aperture sealed and no air in the liner.

When forces 21 are released, nipple 12 returns to its normal shape from the shape shown in phantom lines 22. When enough air has entered to account for the increased volume of chamber 14, check valve 15 closes as illustrated in FIG. 7.

After this process, liner 11 contains no air and chamber 14 has enough pressure to prevent the weight of liquid 19 in liner 11 from causing liner 19 to expand and to prevent the flow of the air back into liner 11. As will be appreciated to those skilled in the art, nursing bottle 1 can be put down and unattended without air being reintroduced into liner 11. Furthermore, as the baby feeds from nursing bottle 1, the volume of liner 11 decreases and the volume of chamber 14 increases. When the volume of chamber 14 increases a sufficient amount to cause a pressure differential, check valve 15 will again open to allow more air into chamber 14.

Figure 8:
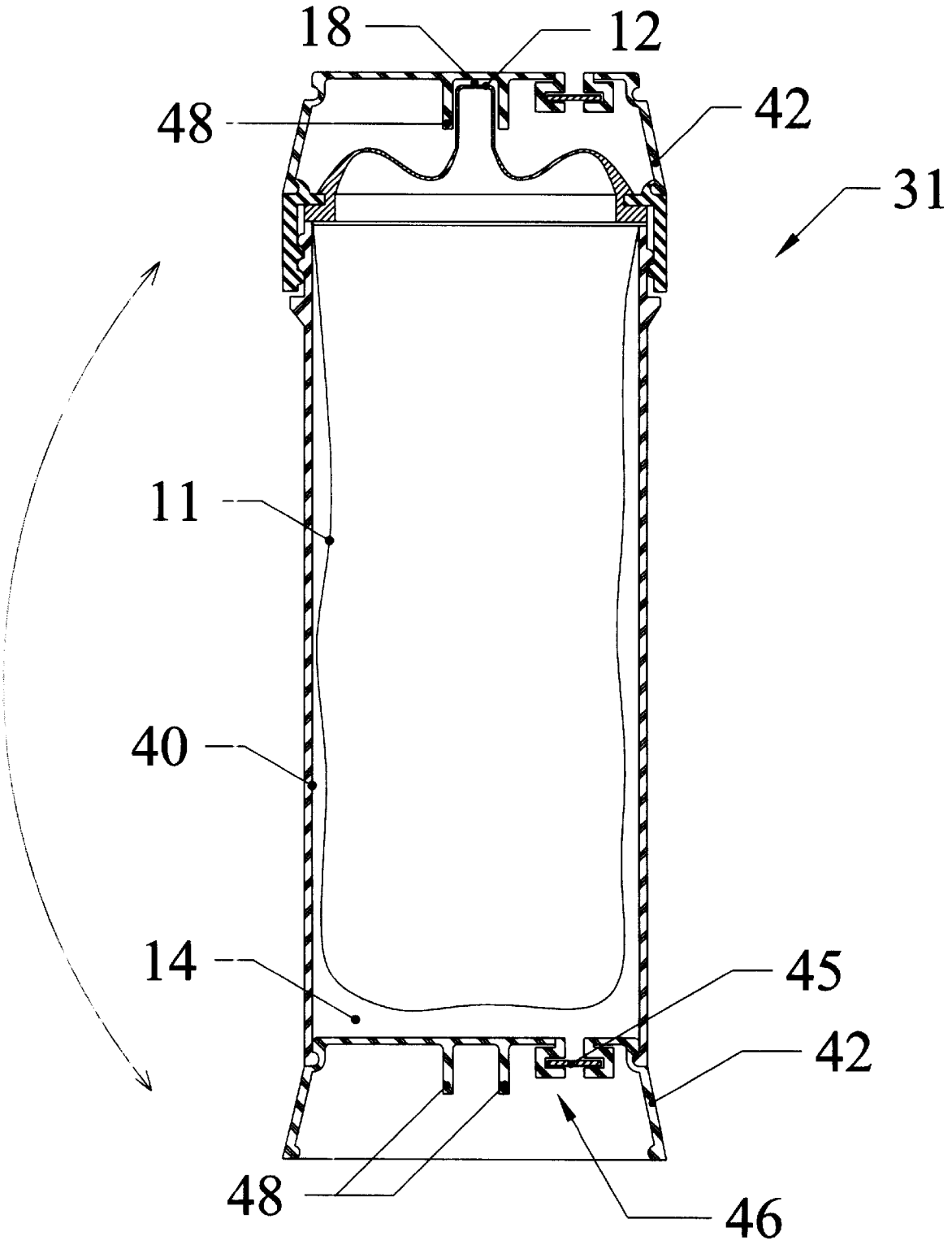
FIG. 8 is a cross-sectional view of another embodiment of a nursing bottle according to the present invention in which the nursing bottle includes a removable cap.

FIG. 8 illustrates one embodiment of the present inventions for a nursing bottle 31 having a body 40 comprising a hollow cylindrical tube that has an open upper end and an open bottom end; body 40 may be either rigid or resilient and is preferably made of plastic. A removable cap 42 comprises an aperture 46 which is sealed with a check valve 45. As illustrated, cap 42 is sealably attachable to the open bottom end of body 40, preferably in a releasable snap-fit manner. When nursing bottle 31 is not in use for feeding an infant, cap 42 is advantageously readily attachable over nipple 12, also in a releasable snap-fit manner over ring 13. Desirably, cap 42 includes a cup-shaped, inner cylinder or annular ring 48 which fits over the portion of nipple 12 having orifice 18 when cap 42 is sealably attached to the upper end of body 40. See phantom lines in FIG. 8.

With cap 42 sealably attached to open bottom end of body 40, the operation of nursing bottle 31 may be similar to nursing bottle 1 shown in FIGS. 4–7 provided body 40 is resilient. Desirably, body 40 is rigid wherein during initial feeding, an infant will ingest the small amount of air in liner 11, and during subsequent feeding a vacuum is created in a chamber 14 to readily draw air into chamber 14 through check valve 45 so as to compensate for the volume of liquid removed from liner 11 and when feeding stops, check valve 45 prevents air from exiting chamber 14 and air from being drawn back through nipple 12 and into liner 11.

Figure 9:
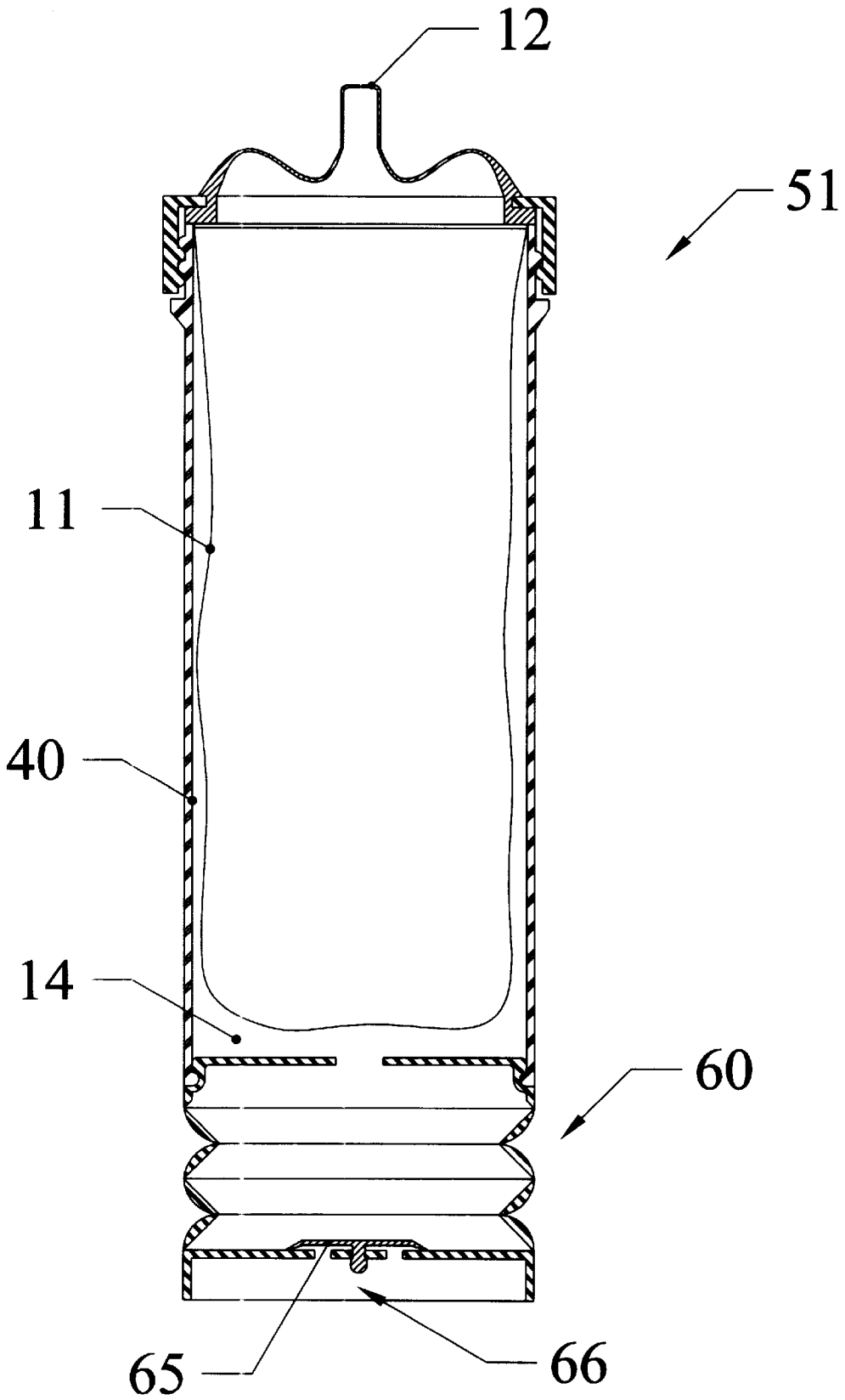
FIG. 9 is a cross-sectional view of another embodiment of a nursing bottle according to the present invention in which the nursing bottle includes a pump.

FIG. 9 illustrates another embodiment of the present invention for a nursing bottle 51 having a body 40 comprising a hollow cylindrical tube having an open upper end and an open bottom end. A removable pump 60 is sealably attachable to the open bottom end preferably in a releasable snap-fit manner. Pump 60 includes an aperture 66 which is sealed with a check valve 65.

Figure 10:
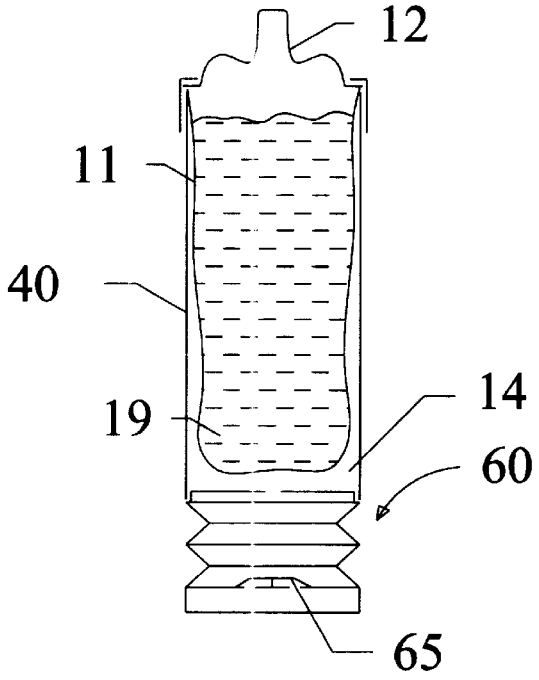
FIG. 10 is a cross-sectional view of the nursing bottle shown in FIG. 9 in an initial state with liquid and air in the liner, e.g., prior to feeding.
Figure 11:
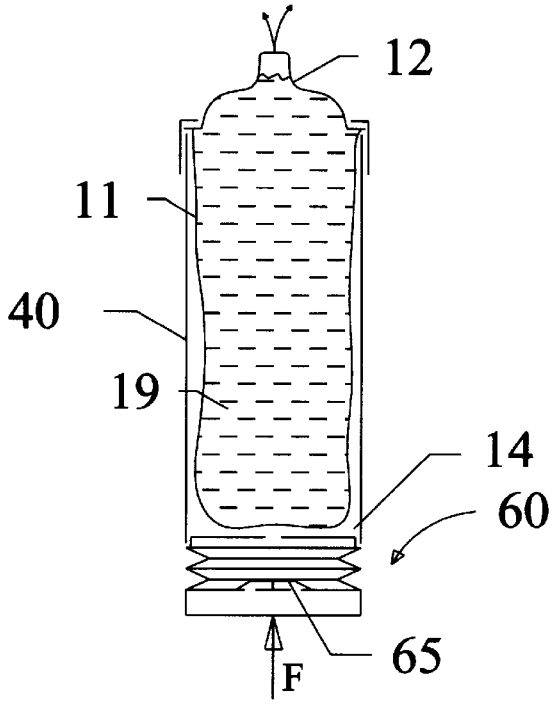
FIG. 11 is a cross-sectional view of the nursing bottle shown in FIG. 10 in which the pump is squeezed so that liquid in the liner rises and air is expelled from the liner.

With pump 60 attached to the open bottom end of body 40, manually operating pump 60 pressurizes air in chamber 14 to remove air from liner 11. The operation of nursing bottle 51 is illustrated with reference to FIGS. 10–13. FIG. 10 shows nursing bottle 51 with liner 11 initially filled with liquid 19 and air, e.g., prior to feeding. FIG. 11 shows applying a force F to operate pump 60, e.g., pushing the bottom of the bottle on a table top, to increase air pressure in chamber 14. As pump 60 is collapsed, the increased pressure in chamber 14 acts on liner 11 to cause liquid 19 in liner 11 to rise which causes air in liner 11 to be expelled through the orifice in nipple 12. Check valve 65 prevents air in pump 60 from escaping.

Figure 12:
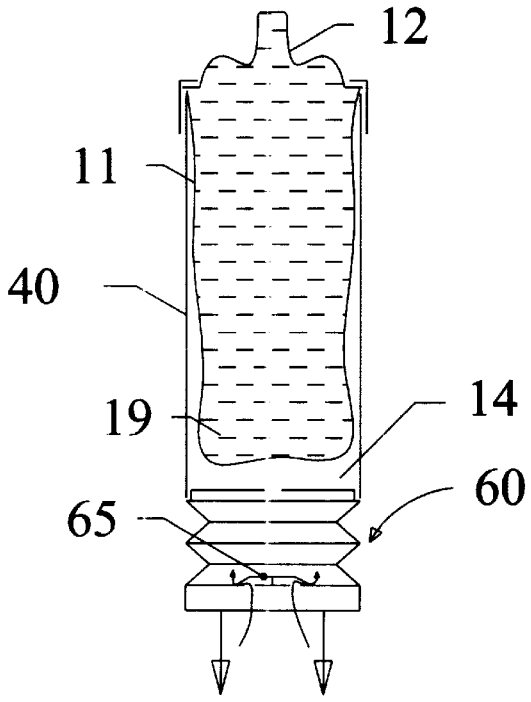
FIG. 12 is a cross-sectional view of the nursing bottle shown in FIG. 11 in which the pump expands and air enters the pump.
Figure 13:
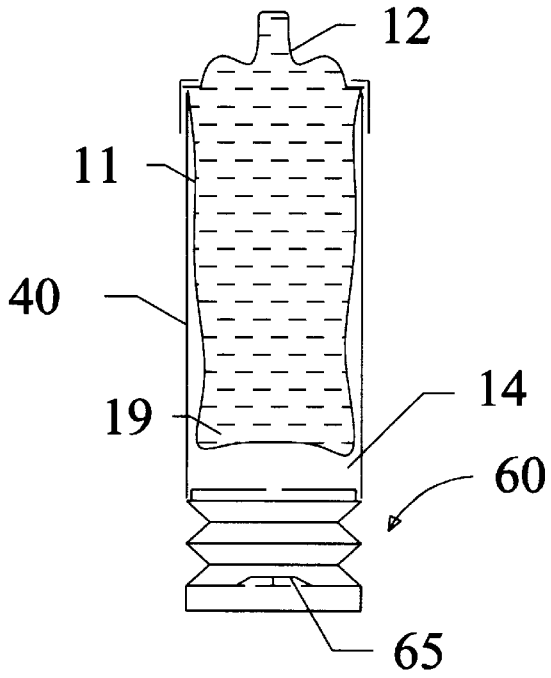
FIG. 13 is a cross-sectional view of the nursing bottle shown in FIG. 13 in which the pump returns to its initial state with no air in the liner, e.g., ready for feeding.

FIG. 12 illustrates nursing bottle 51 when force F is removed from pump 60. With liner 11 collapsed and the air in the liner expelled, liner 11 occupies a smaller volume than it previously did before the application of force F. As pump 60 expands, the air pressure in chamber 14 decreases as its volume increases. Specifically, when the volume of chamber 14 gets to be larger than it was in its original state before the pressure was applied (FIG. 10), the pressure falls below the pressure outside body 40. This pressure differential causes check valve 65 to open and air to enter chamber 14. When force F is released, nipple 12 also returns to its normal shape. When enough air has entered chamber 14 to account for the increased volume, check valve 65 closes as shown in FIG. 13. From the present description, it will be appreciated to those skilled in the art that a second check valve attached to the upper portion of the pump can be employed to better maintain air in the chamber.

After this process, liner 11 contains no air and chamber 14 has enough pressure to prevent the weight of liquid 19 in liner 11 from causing liner 11 to expand and to prevent the flow of air back into liner 11. As will be appreciated by those skilled in the art, nursing bottle 51 can be put down and unattended without air being reintroduced into liner 11. As the baby feeds from nursing bottle 51, the volume of liner 11 decreases and the volume of the chamber 14 increases. When the volume of chamber 14 increases a sufficient amount to cause a pressure differential, check valve 65 will again open to allow air into chamber 14 or, alternatively, the pumping process as described above can be performed again to introduce additional air into chamber 14.

Figure 14:
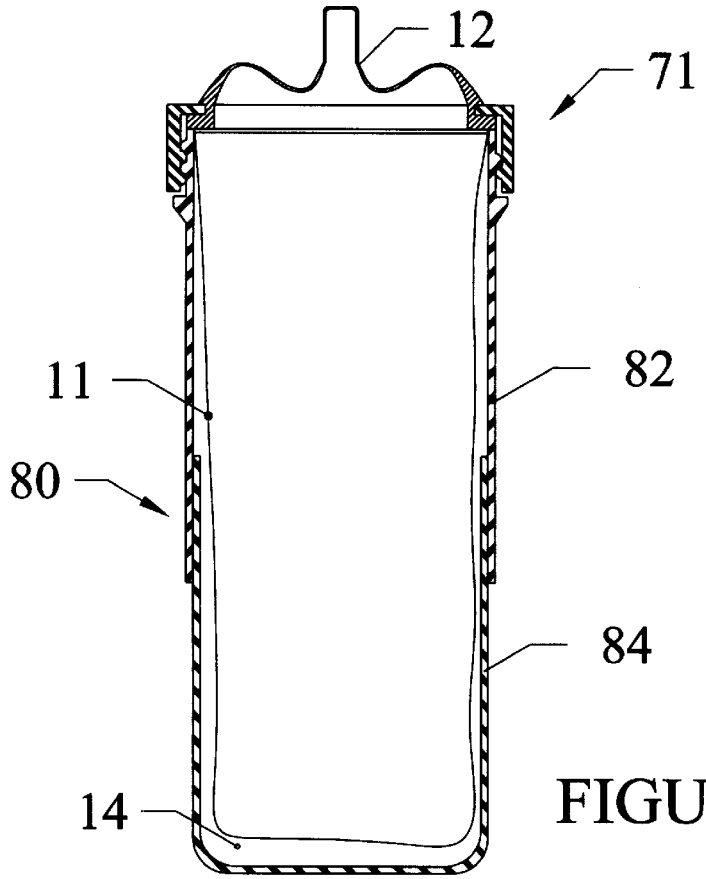
FIG. 14 is a cross-sectional view of another embodiment of a nursing bottle according to the present invention in which the nursing bottle comprises a two-part body.

FIG. 14 illustrates another embodiment of the present invention for a nursing bottle 71 having a body 80 comprising two parts, an upper portion 82 comprising a hollow cylindrical tube having an open upper end and an open bottom end, and a lower portion 84 comprising an open upper end and closed bottom end. Upper and lower portions 82 and 84, respectively, are telescopically slidably and sealably engageable with each other in an air-tight, friction fit manner to pressurize air in chamber 14.

Figure 15:
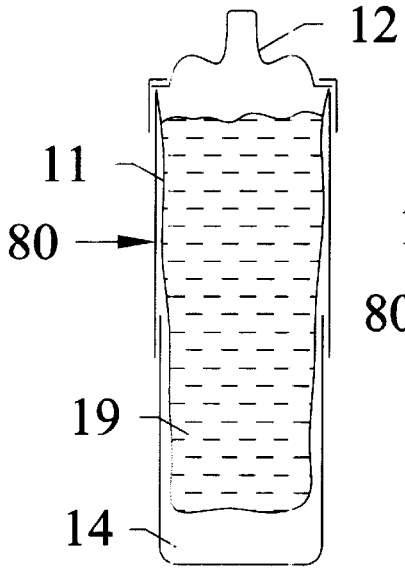
FIG. 15 is a cross-sectional view of the nursing bottle shown in FIG. 14 illustrated in an initial state with air in the liner, e.g., prior to feeding.
Figure 16:
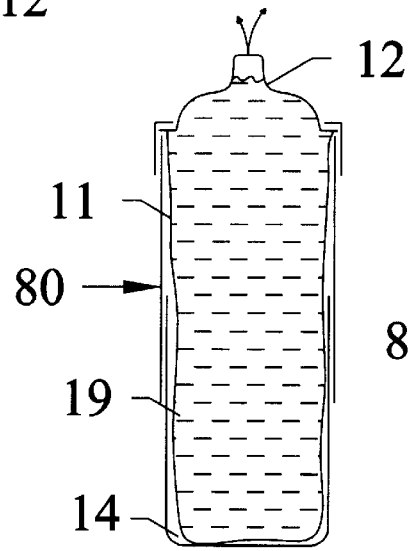
FIG. 16 is a cross-sectional view of the nursing bottle shown in FIG. 15 in which a lower portion of the body is slidable relative to the upper portion so that liquid in the liner rises and air is expelled from the liner.
Figure 17:
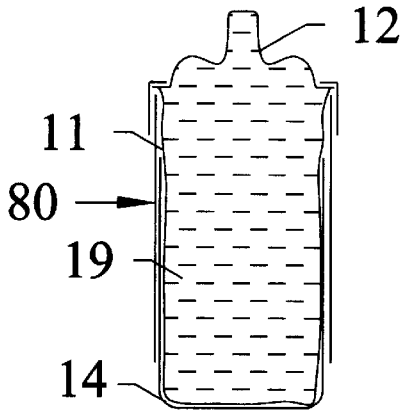
FIG. 17 is a cross-sectional view of the nursing bottle shown in FIG. 16 with no air in the liner, e.g., ready for feeding.

The operation of nursing bottle 71 is best shown in FIGS. 15–17. FIG. 15 shows the nursing bottle 71 with liner 11 initially filled with liquid 19 and air, e.g., prior to feeding. FIG. 16 shows manually sliding lower body portion 84 relative to upper body portion 82, e.g., holding upper portions 82 and pushing lower body portion 84 down on a table top. As the body portions move relative to each other, air pressure in chamber 14 is increased which acts on liner 11 to cause liquid 19 in liner 11 to rise which causes air in liner 11 to be expelled through the orifice in nipple 12.

After this process, as shown in FIG. 17, liner 11 has no air and chamber 14 has enough pressure to prevent the weight of liquid 19 in liner 11 from causing liner 11 to expand and to prevent the flow of air back into liner 11. During feeding, when the chamber's volume increases a sufficient amount, the pumping process can be performed again.

Figure 18:
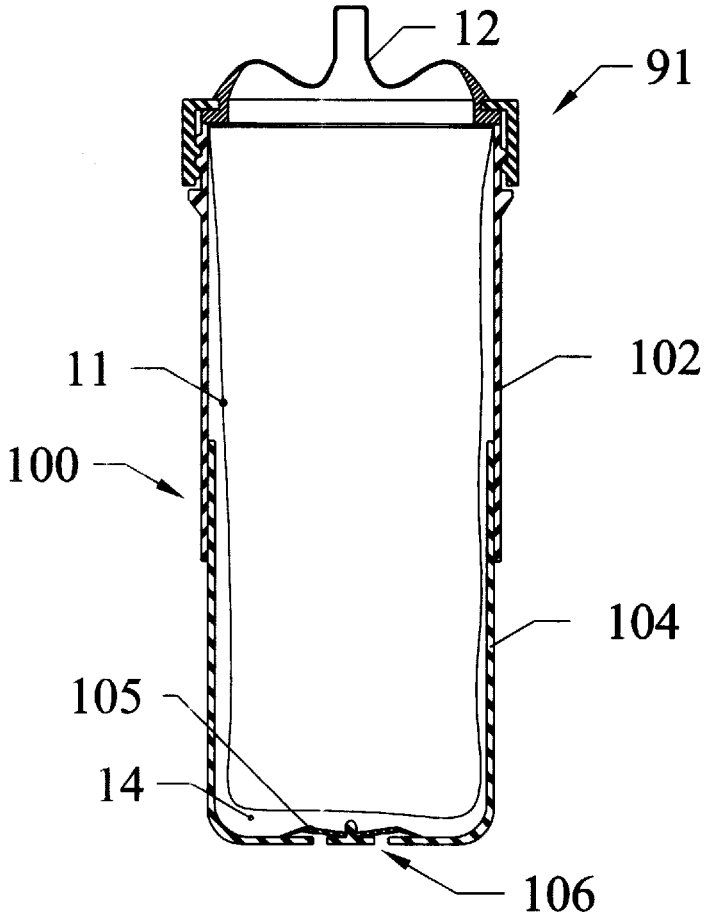
FIG. 18 is a cross-sectional view of another embodiment of a nursing bottle according to the present invention in which the nursing bottle includes a two-part body and a check valve.

FIG. 18 illustrates still another embodiment of the present invention for a nursing bottle 91 having a body 100. In this embodiment, body 100 comprising two parts, an upper portion 102 comprising a hollow cylindrical tube having an open upper end and an open bottom end, and a lower portion 104 comprising an open upper end and closed bottom end. Desirably, lower portion 104 includes an aperture 106 which is sealed with a check valve 105.

Figure 19:
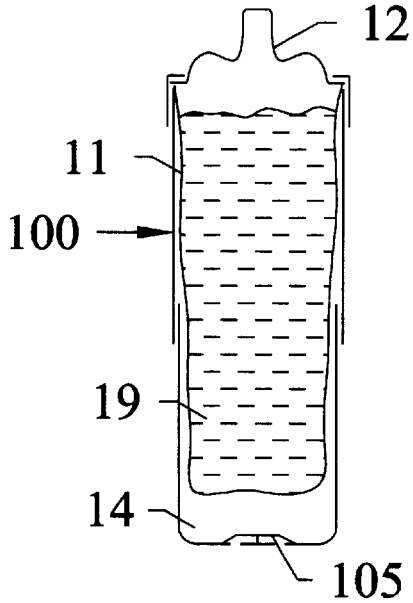
FIG. 19 is a cross-sectional view of the nurser shown in FIG. 18 in an initial state with liquid and air in the liner, e.g., prior to feeding.
Figure 20:
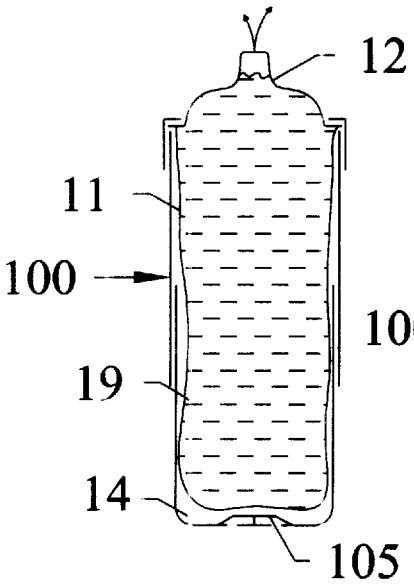
FIG. 20 is a cross-sectional view of the nursing bottle shown in FIG. 18 in which a lower portion of the body is slidable relative to the upper portion so that liquid in the liner rises and air is expelled from the liner.

In this illustrated embodiment lower portion 104 acts as a pump for pressurizing air in chamber 14 and thus removing air in liner 11 as shown in FIGS. 19–20, in the manner as described above with respect to nursing bottle 71. Desirably, check valve 105 prevents air from escaping during this phase of the process.

Figure 21:
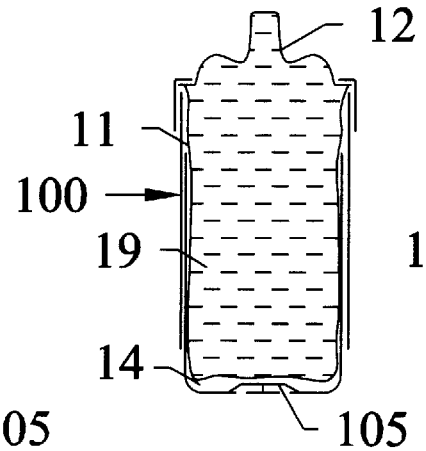
FIG. 21 is a cross-sectional view of the nursing bottle shown in FIG. 20 with no air in the liner, e.g., ready for feeding.
Figure 22:
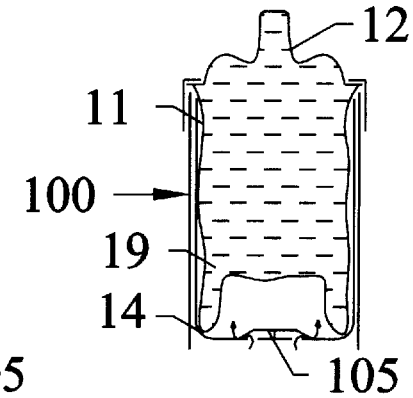
FIG. 22 is a cross-sectional view of the nursing bottle shown in FIG. 21 when used during feeding.

As shown in FIG. 21, liner 11 has no air and chamber 14 has enough pressure to prevent the weight of liquid 19 in liner 11 from causing liner 11 to expand. As shown in FIG. 22, as an infant feeds from nursing bottle 91, the volume of liner 11 decreases and the volume of chamber 14 increases. When the volume of chamber 14 increases a sufficient amount, a pressure differential results in chamber 14, and advantageously, check valve 105 will again open to allow air into chamber 14.

From the present invention it will be appreciated to those skilled in the art that the check valve and/or pump need not be placed on the bottom of the bottle but can be placed elsewhere on the body, e.g., on the body adjacent the top or open upper end to suit the particular application or for ease of manufacture, etc. Furthermore, the present design allows one to use the bottle even if a liner is not available, i.e., the employment of the bottle with a body having a check valve is usable without a liner although there may be air ingestion by the infant.

Thus, while only several embodiments of the present invention have been shown and described, many changes and modifications may be made relative thereto without departing from the spirit and scope of the invention.

What is claimed is:

1. A nursing bottle comprising;

a body, open at an upper end, and a lower end;

a flexible liner, open at one end, said liner open end suspended from said upper open end of said body;

a feeding nipple attachable to the body upper end;

and a cap with an aperture, and a valve in said aperture, attachable to the open lower end of the body, and upper end over said feeding nipple, that when the cap is attached to the lower end of the body, said cap creates a chamber between the liner and the body, that when liquid contained within the liner is removed during feeding, a vacuum is created in said chamber to readily draw air into said chamber through said valve so as to compensate for the volume of liquid removed from said liner, and when feeding stops, said valve prevents air from being drawn through said nipple into said liner.

2. A nurser according to claim 1, that when the cap is attached to the upper end over the nipple, the nipple is covered, and is protected from unnecessary contamination.

3. A method of feeding an infant or animal with a bottle, comprising:

providing a bottle to an infant or animal, the bottle having:

a body, open at an upper end and a lower end;

a flexible liner containing liquid to be feed to the infant or animal open at one end, said liner open end suspended from said upper open end of said body;

a feeding nipple attached to the body upper end;

and a cap with an aperture, and a valve in said aperture, attachable to the open lower end of the body, and upper end over said feeding nipple;

attaching the cap to the lower end of the body so that the cap creates a chamber between the liner and the body, and the liquid contained within the liner is removed during this feeding and a vacuum is created in said chamber to readily draw air into said chamber through said valve so as to compensate for the volume of liquid removed from said liner, and when this feeding stops, said valve prevents air from being drawn through said nipple into said liner.

4. A nursing bottle comprising;

a resilient body, open at an upper end, and a lower end;

a flexible liner, open at one end, said liner open end suspended from said upper open end of said body;

a feeding nipple attachable to the body upper end;

and a cap with an aperture, and a valve in said aperture, attachable to the open lower end of the body, and upper end over said feeding nipple, that when the cap is attached to the lower end of the body, said cap creates a chamber between the liner and the body, whereby, filling the liner, and applying pressure to the body to collapse the body to force air in the liner through the nipple, releasing the pressure to the body a vacuum is created in said chamber to readily draw air into said chamber through said valve so as to compensate for the volume of liquid removed from said liner, and when feeding stops, said valve prevents air from being drawn through said nipple into said liner.

5. A nurser according to claim 4, that when the cap is attached to the upper end over the nipple, the nipple is covered, and is protected from unnecessary contamination.

6. A method of feeding an infant or animal with a bottle, comprising:

providing a bottle to an infant or animal the bottle having:

a resilient body, open at an upper end and a lower end;

a flexible liner containing liquid to be feed to the infant or animal, open at one end, said liner open end suspended from said upper open end of said body;

a feeding nipple attached to the body upper end;

and a cap with an aperture, and a valve in said aperture, attachable to the open lower end of the body, and upper end over said feeding nipple, that when the cap is attached to the lower end of the body; the cap creates a chamber between the liner and the body, where by, filling the liner, and applying pressure to the body to collapse the body to force air in the liner through the nipple, releasing the pressure to the body a vacuum is created in said chamber to readily draw air into said chamber through said valve so as to compensate for the volume of liquid removed from said liner, and when this feeding stops, said valve prevents air from being drawn through said nipple into said liner.

* * * * *